United States Patent [19]

Heimberger

[11] Patent Number: 4,924,914

[45] Date of Patent: May 15, 1990

[54] WEAVING A SLIDE-FASTENER STRINGER HALF WITH AN INTEGRAL COUPLING COIL

[75] Inventor: Helmut Heimberger, Cham, Switzerland

[73] Assignee: Opti Patent-, Forschungs-und Fabrikations-AG, Riedern-Allmeind, Switzerland

[21] Appl. No.: 329,670

[22] Filed: Mar. 28, 1989

Related U.S. Application Data

[63] Continuation-in-part of Ser. No. 126,414, Nov. 25, 1987, abandoned.

[30] Foreign Application Priority Data

Nov. 25, 1986 [DE] Fed. Rep. of Germany ..... 3640194

[51] Int. Cl.[5] ..... D03D 41/00; D03D 47/06

[52] U.S. Cl. ..... 139/11; 139/384 B

[58] Field of Search ..... 139/11, 35, 116, 384 A, 139/384 R, 384 B

[56] References Cited

U.S. PATENT DOCUMENTS

| | | | |
|---|---|---|---|
| 2,651,330 | 9/1953 | Mostertz | 139/11 |
| 3,123,103 | 3/1964 | Hendley | 139/11 |
| 3,258,034 | 6/1966 | Gerlach | 139/11 |
| 3,545,497 | 12/1970 | Burbank | 139/11 |
| 3,905,401 | 9/1975 | Steingruebner | 139/11 |
| 3,986,531 | 10/1976 | Lobasov | 139/11 |
| 4,134,184 | 1/1979 | Motta | 139/116 |

FOREIGN PATENT DOCUMENTS 2259434 6/1974 Fed. Rep. of Germany .

OTHER PUBLICATIONS

"Bandwebetechnik" (Verlag Sauerländer, 1988) by Hans Walter KIPP (Book).

*Primary Examiner*—Andrew M. Falik

*Attorney, Agent, or Firm*—Herbert Dubno; Andrew Wilford

[57] ABSTRACT

A slide-fastener stringer is made by feeding a warp of warp filaments in a longitudinal warp direction to a weaving location, feeding to an edge of the warp at the weaving location a coupling coil formed by a multiplicity of turns each forming a coupling head directed transversely away from the warp and a coupling part extending at least generally longitudinally, feeding to the weaving location within the coil a thick filler cord, and weaving through the warp filaments and around the coupling parts and filler cord between the heads at least one weft filament. In order to maintain coil pitch exact both the coil and filler cord are positively engaged at a location immediately longitudinally upstream of the weaving location with a feed and guide element so as to retard advance of the feed and guide element and create in both the coil and in the filler cord a tension between the feed and guide element and the weaving location.

1 Claim, 4 Drawing Sheets

WEAVING A SLIDE-FASTENER STRINGER HALF WITH AN INTEGRAL COUPLING COIL

CROSS-REFERENCE TO RELATED APPLICATION

This application is a continuation-in-part of copending patent application 126,414 filed 25 Nov. 1987 abandoned.

FIELD OF THE INVENTION

My present invention relates to a method of and an apparatus for making a slide-fastener stringer half and, more particularly, to the weaving of a woven-tape stringer half in which the coupling coil is held in the tape by a weft laid into the warp by a needle of an automatic shuttleless loom.

BACKGROUND OF THE INVENTION

A slide fastener comprises a pair of substantially identical stringer halves having confronting edges provided with respective rows of coupling heads so positioned and spaced that, upon movement of a slider along these rows, the heads can be interdigitated to close the fastener or can be separated to open it depending upon the direction of movement of the slider. The of a respective coupling coil made of a synthetic-resin monofilament also having shanks reaching toward the interior of a respective support tape. Each turn of each coil is formed with, in addition to a coupling head, a coupling member or part that connects it to the adjacent turn and that is somehow connected to the textile tape to hold the coil in place on the edge thereof.

While tapes of different constructions are widely used and there are many different ways of connecting the coupling coil to the tape, the present invention is concerned with woven tapes in which the coupling coil is woven into the tape and is fed like another warp filament to the latter as the tape is formed in an automatic tape-weaving machine in a direction parallel to the warp so that the coupling coil is engaged by the weft in the weaving process. Such a process is described in detail in U.S. patents 2,651,330 and 3,545,497 of Mostertz and Burbank, respectively, in German patent document 2,359,434 of C. Menegatto, and in the book *Bandwebtechnik* (Verlag Sauerlander; 1988) by Hans Walter Kipp. In such arrangements the warp comprises at its outer edge a pair of so-called wing warps that in effect give the warp the section of recumbent Y with a pair of arms that vertically flank the coupling member. The warp wings are alternately shedded and aligned with the needle of a shuttleless loom that makes with each back-and-forth a double pick, in conjunction with a hook on the opposite side of the shed, so that the coupling parts of the coil turns lie between the warp wings and the weft filaments wrap around them.

The problem with this system is that the coupling element is a fairly hard-to-handle and bulky coil compared to the warp. As it bends and moves with the process it becomes very difficult to maintain and exact pitch or longitudinal spacing between adjacent coupling heads. Similarly once installed the weft filaments that secure it laterally to the tape have a poor purchase on the angled coupling parts, so that there is little to ensure that, even if set correctly at manufacture, exact pitch is maintained. Such pitch must, however, be very exact in the slide-fastener stringer halves in order to ensure that the fastener they eventually form will close readily and thereafter remain closed. Too close spacing makes the fastener very difficult to close and difficult to open, and too wide spacing makes the fastener open when not intended.

Frequently as described in German patent document 3,612,612 and in the above-cited Burbank patent the coil is provided with a filler cord that is constituted as a thick multistrand filament that extends up within the helicoid formed by the coupling coil. Such a cord gives a good purchase to the weft filaments and in general stabilizes the coupling member. In such an arrangement there is little shifting of the turns of the coil once the stringer tapes are assembled, but the coil shifts on the tape prior to being woven into the tape and such misplacement is then preserved when the weft is installed. In addition, the weft filaments, when looped around the filler cord, typically constrict it and thereby effectively shorten the cord. The coupling coil which surrounds the filler cord is not correspondingly shortened, so that this shifting of the cord in the coil can cause periodic displacements and dislocations that are reflected in undesired pitch irregularities.

The point at which the coil is fed to the weaving location is relatively distant from this location and the warp-yarn holder of the automatic weaving machine which feeds the warp yarns to this location is generally located between the coil feeder and the weaving location. The coil runs practically without tension through the feeder and to the weaving location.

OBJECTS OF THE INVENTION

It is, therefore, the principal object of the present invention to provide an improved method of making a slide-fastener stringer half whereby these drawbacks are obviated.

Another object of the invention is to provide an improved apparatus for carrying out the method of the invention.

Still another object of my invention is to provide a method of and an apparatus for the continuous production of a stringer half on a shuttleless loom which allows the use of coupling coils with filler cords in a problem-free manner and, in particular, permits the continuous production for long periods of time of exceptionally long lengths of the stringer half in a totally automatic manner without the drawbacks enumerated above.

SUMMARY OF THE INVENTION

The instant invention is an improvement on the classic method of making a slide-fastener stringer half that comprises the steps of feeding a warp of warp filaments in a longitudinal warp direction to a weaving location, feeding to an edge of the warp at the weaving location a coupling coil formed by a multiplicity of turns each forming a coupling head directed transversely away from the warp and a coupling part extending at least generally longitudinally, feeding to the weaving location within the coil a thick filler cord, ad weaving through the warp filaments and around the coupling parts and filler cord between the heads at least one weft filament. The invention comprises the steps of continuously positively engaging both the coil and filler cord at a location immediately longitudinally upstream of the weaving location with a feed and guide element and retarding advance of the feed and guide element so as to create in both the coil and in the filler cord a tension between the feed and guide element and the weaving location.

By providing the feeding device so that it is directly adjacent the weaving location and positively engages the coil with formations or teeth spaced apart by the pitch of the coil in the stretched state resulting from the tension, I am able to ensure that construction of the filler cord and the shortening thereof resulting from such constriction will be matched by an identical contraction of the coil at the weaving location so that relative motion of the coil and the cord does not occur. Thus the coil and its filler cord remain taut between the guide/feed element and the location where it is incorporated into the tape.

According to this invention the guide and feed element presses the filler cord against the coupling part. In fact it crimps the filler cord into the coil. This is done by providing the guide element, which can be a toothed wheel, spiral-ridged worm, rack, or the like with teeth or equivalent formations that are long enough to engage between the turns of the coil with the filler cord without, of course, cutting or damaging same.

The apparatus according to this invention comprises a standard set of heddles and the like for forming a warp of warp filaments and for feeding same in a longitudinal warp direction to a weaving location, a guide terminating immediately longitudinally upstream of the weaving location for feeding to an edge of the warp at the weaving location a coupling coil formed by a multiplicity of turns each forming a coupling head directed transversely away from the warp and a coupling part extending at least generally longitudinally and a thick filler cord extending longitudinally within the turns of the coil, and a feed element closely juxtaposed with the weaving location, cooperating with the guide, and having movable teeth engageable between the turns with the filler cord and longitudinally displaceable with same. The feed element's advance is retarded so as to create in both the coil and the filler cord a tension between the guide element and the weaving location. A shuttleless-loom needle weaves at least one weft filament through the warp filaments and around the coupling parts and filler cord between the heads. Thus the warp and weft filaments are formed into a tape into which the coil and its filler cord are woven.

The tension is provided by a 200 g to 600 g weight hung on the coupling coil and cord and connected thereby to the feed element. The guide is a tube terminating immediately adjacent the weaving location.

DESCRIPTION OF THE DRAWING

The above and other objects, features, and advantages will become more readily apparent from the following, reference being made to the accompanying drawing in which.

SPECIFIC DESCRIPTION

Figure 1:
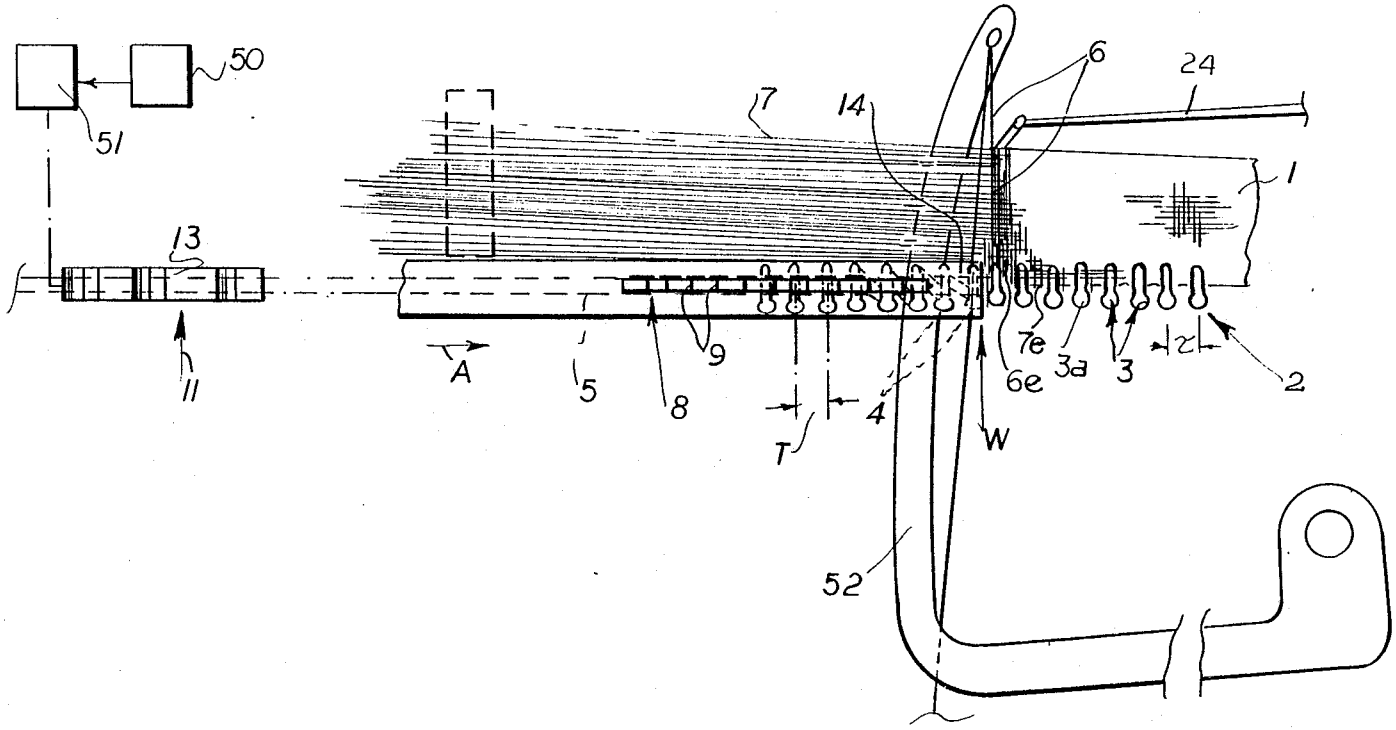
FIG. 1 is a highly diagrammatic plan view of a portion of an automatic weaving machine according to the invention.
Figure 2:
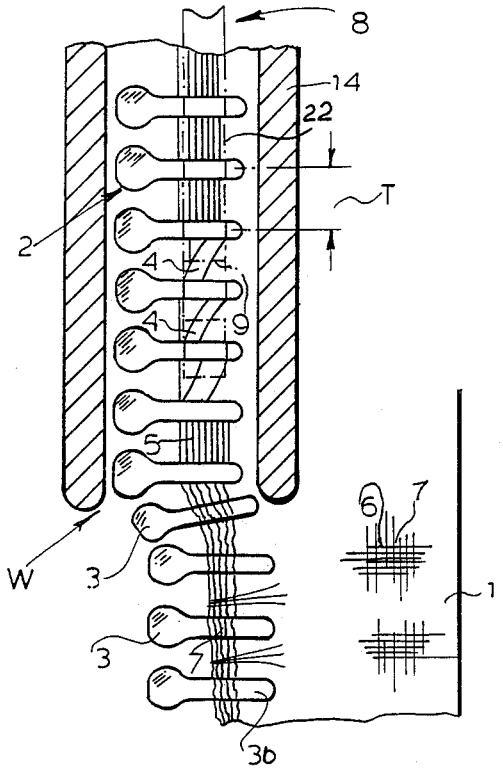
FIG. 2 is a detail view of a portion of the apparatus seen in FIG. 1 drawn to a larger scale and partly in longitudinal section.
Figure 3:
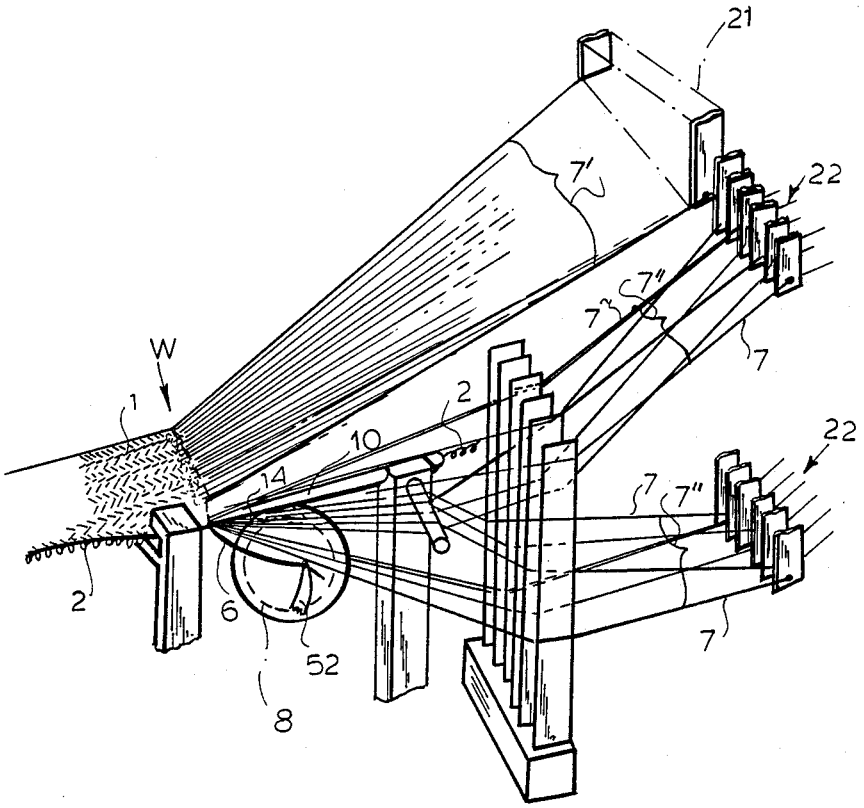
FIG.3 is a small-scale perspective view illustrating further features of the apparatus of this invention.

In FIGS. 1, 2 and 3, I have shown a portion of the basic elements of an automatic tape-making machine and a part of the slide-fastener stringer half made thereon. The stringer half comprises a woven tape 1 and a coupling coil 2 in turn formed of a succession of identical turns forming heads 3 projecting away from the tape 1 and spaced apart at an interhead spacing or pitch t (FIG. 1) which is such that these heads 3 can interdigitate with a complementary row of such heads of another coupling coil on another tape of the second stringer half in a slide-fastener stringer of the type described above. The coil 2 is composed of a synthetic resin monofilament of a polyamide or polyester wound around a multifilament filler yarn or cord 5.

The coil 2 is fed under tension to a feed tube 14 and thus is stretched to a pitch T (FIG. 2) which is slightly greater than the pitch t the coil 2 has when not under tension in the woven stringer half. In FIG. 2 portions of the textile cord 5 extending through the coil have been broken away so that connecting members or parts 4 which join successive turns of the coil 2 are visible. The cord 5 is fed into the coil 2 in a manner known per se as represented by a cord feeder 50 at a coil-forming station 51. The formation of the coil 2 and the insertion of the cord 5 therein are known in the art and need not be separately described.

From FIGS. 1, 2, and 3 it will also be apparent that the shuttleless loom has a weaving location W at which the support tape 1 is woven from at least one weft yarn 6 and from warp yarns 7 forming a main warp 7' and a pair of warp wings 7'' as described in greater detail in above-cited U.S. patent 3,545,497 of Burbank, to which reference should be made for further details regarding the weaving procedure employed here and how the tape is beaten up. The coupling coil 2 fed to the weaving location in the longitudinal direction indicated by arrow A which is also the direction in which the warp yarns 7 extend.

The feeding of the coil 2 is effected at a relatively small but nevertheless sufficient tension so that the stretch of the coil 2 will allow a relaxation thereof at the weaving location W which will correspond to the degree to which the cord 5 is contracted when binding weft yarns 6 are engaged around and constrict the cord 5 (see FIG. 2).

At the weaving location W, the turns of the coil 2 are sandwiched between the two wings 7' and 7'' of the warp yarns 7 along their shanks **3*b* while the connecting members 4 which lie generally midway of these shanks are engaged by the binding weft yarns 6. The number of binding warp yarns between the coupling members is, of course, a function of the desired pitch t. As described in the Burbank patent, heddle sets 21 control the shedding of the main warp 7' and heddle sets 22 the wing warps 7'', and the weft 6 is inserted as a double pick by a needle 52 cooperating with a hook 24**.

Figure 4:
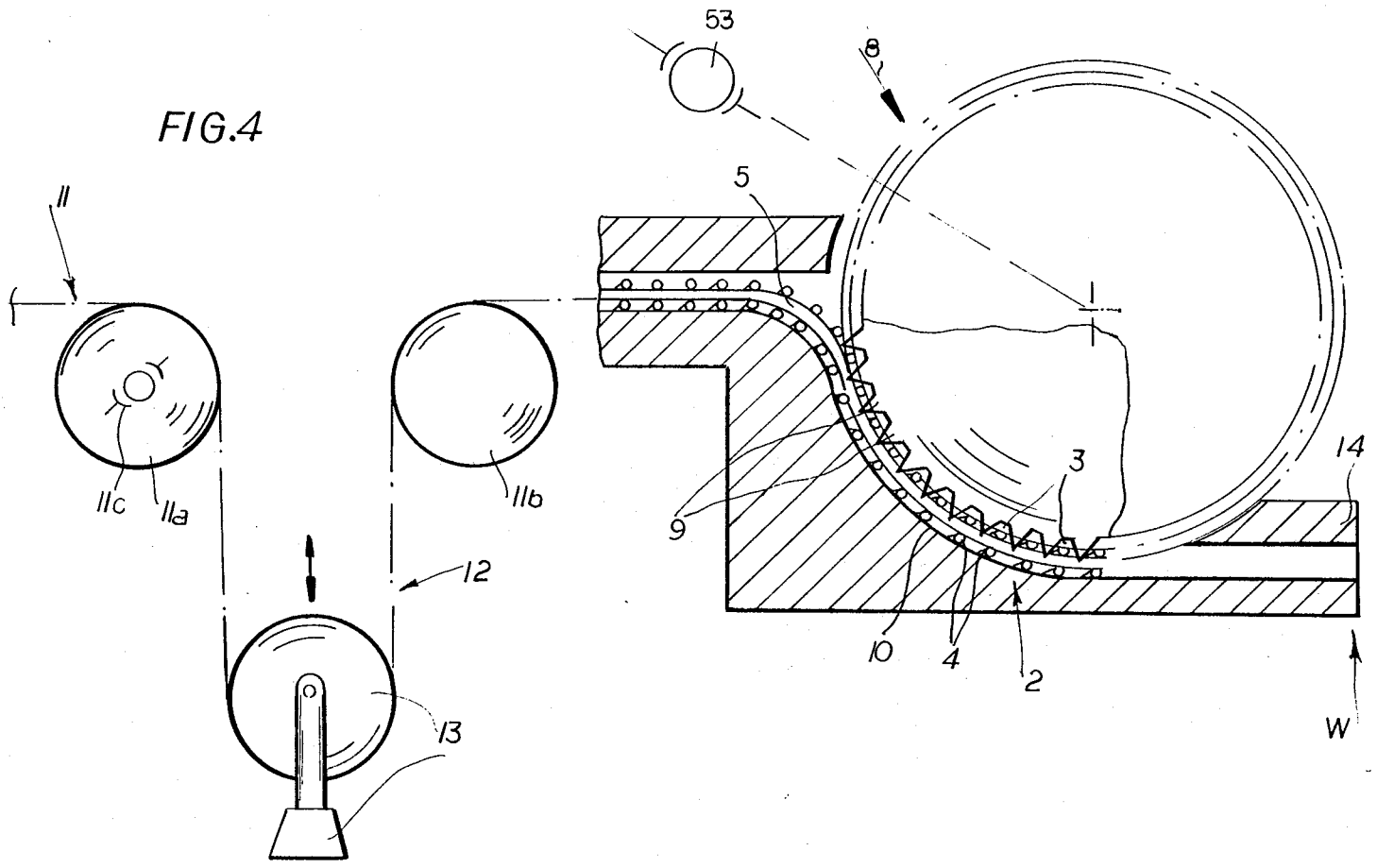
FIG. 4 is a view generally of the guide and feed system of this invention, seen in vertical section.

As can be seen from FIGS. 1, 2 and 4, the coupling coil 2 is fed to the weaving location W with the filler cord 5 therein so that the filler cord 5, when engaged by the weft yarns 6, is constricted and bent since the binding weft yarns are laid into the warp shed by the needle 52 of the machine under tension.

As is also apparent from FIG. 4, the feeder 8 can be a toothed wheel which has teeth 9 engaging between the coupling members 3 and also pressing into the cord 5 to press the cord 5 against the coupling members 4 and positively advance the cord 5 with the coupling coil 2, which is tensioned into the space between the teeth 9, to the weaving location W. The feeder 8 is driven by a drive means represented at 53 sufficient to overcome the tension which is applied to the coil. In addition the feeder 8 is located directly upstream of the weaving location.

The tension-generating device represented generally at 11, therefore, applies tension tw the coil 2 and the cord 5 before these are engaged by the teeth 9 so that they are engaged by the teeth 9 in the stretched state mentioned previously. The alternating engagement of each turn of the coil and the respective length of cord 5 by a tooth 9 under tension in a direction away from the direction of feed and the supply of the coil 2 and the cord 5 by positively advancing both together to the weaving location permits the constriction of the cord 5 by the binding weft yarns to be matched by a corresponding slight contraction of the coupling coil 2 where the coupling coil 2 is woven in place without tension so that there is no detrimental relative movement between the coupling coil 2 and the filler cord 5.

The drive 53 exerts a torque sufficient to overcome the traction-retarding advance of the coil 2 and cord 5 and to apply the tension. The teeth 9 cooperate with a guide path or channel 10 extending partly around the toothed wheel 8 and, of course, the teeth 9 have a length such that these teeth 9 not only can engage between the coupling members 3 but also can penetrate into the cord 5 without damaging it but so as to crimp it effectively with the coil 2.

The tension-generating unit 11 as seen in FIG. 4 comprises a pair of rollers 11*a* and 11*b*, of which the roller 11*a* may have a friction brake 11*c*, and a compensating loop 12 formed between the rollers 11*a* and 11*b* and having a 400 g weight 13, e.g. another roller riding on the coil, to generate a tension as described previously.

The channel 10 can have a transition to a guide sleeve 14 which extends the wheel 8 and the weaving location W, it being understood that the sleeve 14 is as short as possible.

Of course, other feeders may be used to positively advance the coil 2 and the cord 5 together and without relative movement and with a light tension or stretch if desired. A transport worm or a wheel provided with pins or even a ram with ratchet action can be used for this purpose.

I claim:

1. An apparatus for making a slide-fastener stringer half, the apparatus comprising:

means for forming a warp of warp filaments and for feeding same in a longitudinal warp direction to a weaving location;

means including a tubular guide terminating at a downstream end immediately longitudinally upstream of the weaving location for feeding to an edge of the warp at the weaving location a coupling coil formed by a multiplicity of turns each forming a coupling head directed transversely away from the warp and a coupling part extending at least generally longitudinally and a thick filler cord extending longitudinally within the turns of the coil;

a feed element closely juxtaposed with the weaving location at an upstream end of the guide, and having movable teeth engageable between the turns with the filler cord and longitudinally displaceable with same;

control means including a weight hung on the coupling coil and cord and connected thereby to the feed element for retarding advance of the teeth so as to create in both the coil and the filler cord a tension between the guide element and the weaving location; and means including a shuttleless-loom needle for weaving at least one weft filament through the warp filaments and around the coupling parts and filler cord between the heads with sufficient force to at least partially overcome the tension in the filler cord and coil, whereby the warp and weft filaments are formed into a tape into which the coil and its filler cord are woven.

* * * * *